US008348244B2

(12) United States Patent
Kojima et al.

(10) Patent No.: US 8,348,244 B2
(45) Date of Patent: Jan. 8, 2013

(54) CARBURETOR VALVE ADJUSTMENT LIMITER

(75) Inventors: Tetsuji Kojima, Shibata-Gun (JP); Hidenori Sasaki, Shibata-Gun (JP); Masashi Sasaki, Kakuda (JP); Hitoshi Terakado, Sendai (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 370 days.

(21) Appl. No.: 12/843,008

(22) Filed: Jul. 24, 2010

(65) Prior Publication Data

US 2012/0018908 A1 Jan. 26, 2012

(51) Int. Cl.
*F02M 19/04* (2006.01)

(52) U.S. Cl. ..... 261/71; 137/382; 261/DIG. 38; 261/DIG. 84

(58) Field of Classification Search ..... 261/71, 261/DIG. 38, DIG. 84; 137/382, 382.5; 251/227; 411/301, 412, 542
See application file for complete search history.

(56) References Cited

U.S. PATENT DOCUMENTS

| | | | | |
|---|---|---|---|---|
| 3,618,906 | A * | 11/1971 | Charron | 261/41.5 |
| 4,333,891 | A * | 6/1982 | Miller | 261/41.5 |
| 4,752,420 | A * | 6/1988 | Nagasaka et al. | 261/35 |
| 5,236,634 | A | 8/1993 | Hammett et al. | |
| 5,252,261 | A | 10/1993 | Gerhardy | |
| 5,322,645 | A | 6/1994 | Hammett et al. | |
| 5,635,113 | A * | 6/1997 | Walsh et al. | 261/71 |
| 5,667,734 | A | 9/1997 | Ohgane | |
| 5,707,561 | A | 1/1998 | Swanson | |
| 5,753,148 | A | 5/1998 | King et al. | |
| 5,984,281 | A | 11/1999 | Hacker et al. | |
| 6,003,845 | A | 12/1999 | Kus | |
| 6,402,125 | B1 | 6/2002 | Burns et al. | |
| 6,467,757 | B1 | 10/2002 | Douyama | |
| 6,540,212 | B2 | 4/2003 | Burns et al. | |
| 7,097,165 | B1 | 8/2006 | Braun | |
| 2005/0173816 | A1 * | 8/2005 | Vick et al. | 261/71 |

FOREIGN PATENT DOCUMENTS

| | | | | |
|---|---|---|---|---|
| JP | 53-88422 | A * | 8/1978 | 261/71 |
| JP | 8312465 | | 11/1996 | |

* cited by examiner

*Primary Examiner* — Richard L Chiesa
(74) *Attorney, Agent, or Firm* — Reising Ethington P.C.

(57) ABSTRACT

A carburetor valve and limiter cap assembly for limiting adjustment of fuel flow in a carburetor may include a needle valve and a limiter cap. The needle valve may have a tip, a threaded portion, a head having a flange with an outer diameter greater than the rest of the head, and one or more serrations formed on the head. The limiter cap may have a sidewall, a tab extending outwardly from the sidewall, a first cavity having an inner diameter sized for an interference fit with the flange, and at least one driving feature to engage at least one serration so that rotation of the limiter cap causes rotation of the needle valve. The interference fit between the flange and the limiter cap inhibits removal of the limiter cap from the needle valve to prevent undesired adjustment of the needle valves by an end user.

25 Claims, 5 Drawing Sheets

CARBURETOR VALVE ADJUSTMENT LIMITER

TECHNICAL FIELD

The present disclosure relates generally to a needle valve with an adjustment limiter cap, and a carburetor using them.

BACKGROUND

Government agencies are applying exhaust emission control regulations to protect the environment. These regulations are being applied to combustion engines including portable or two cycle engines used in equipment such as chain saws, lawn mowers and hedge trimmers, as well as four cycle engines. One means of limiting excessive exhaust emissions in a combustion engine is to restrict the maximum amount of fuel delivered to the engine combustion chamber. This maximum fuel amount is pre-set on each individual engine by the engine manufacturer with the understanding that the end user requires some adjustment capability to meet changing work conditions and environmental factors such as altitude, dirty air filter, and different fuel. Not only is it desirable to limit the richness of the fuel to air mixture because of exhaust emission regulatory concerns, but the engine manufacturer may also want to restrict minimum amounts of fuel, or the leanness of the fuel to air mixture. For example, a user desiring more power from a two cycle engine may attempt to operate the engine in an ultra-lean state. This may affect desired cooling of the engine.

SUMMARY

A carburetor valve and limiter cap assembly for limiting adjustment of fuel flow in a carburetor may include a needle valve and a limiter cap. The needle valve may have a tip, a threaded portion, a head having a flange with an outer diameter greater than the rest of the head, and one or more serrations formed on the head. The limiter cap may have a sidewall, a tab extending outwardly from the sidewall, a first cavity having an inner diameter sized for an interference fit with the flange, and at least one driving feature to engage at least one serration so that rotation of the limiter cap causes rotation of the needle valve. The interference fit between the flange and the limiter cap inhibits removal of the limiter cap from the needle valve to prevent undesired adjustment of the needle valves by an end user.

A carburetor is also disclosed and may include a body having a fuel passage formed therein, and a needle valve passage communicating with the fuel passage and having a threaded portion. A needle valve may be received in the needle valve passage and have a tip movable relative to a portion of the fuel passage to control the flow rate of fuel in the fuel passage. The needle valve may also have a threaded portion engaged with the threaded portion of the needle valve passage, a head having a flange with an outer diameter greater than the rest of the head, and one or more serrations formed on the head. A limiter cap may have a sidewall, a tab extending outwardly from the sidewall, a first cavity having an inner diameter sized for an interference fit with the flange, and at least one driving feature to engage at least one serration so that rotation of the limiter cap causes rotation of the needle valve. The interference fit between the flange and the limiter cap inhibits removal of the limiter cap from the needle valve.

BRIEF DESCRIPTION OF THE DRAWINGS

The following detailed description of exemplary embodiments and best mode will be set forth with reference to the accompanying drawings, in which.

DETAILED DESCRIPTION OF PREFERRED EMBODIMENTS

Figure 2:
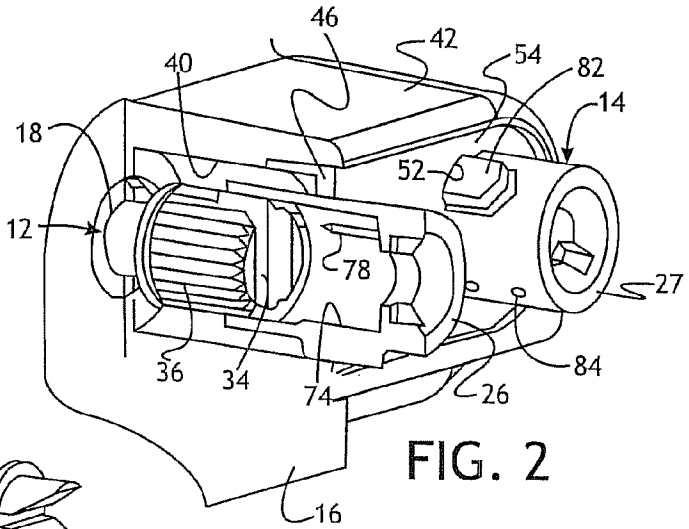
FIG. 2 is an enlarged, fragmentary view of a portion of FIG. 1 showing the ends of the needle valves and the limiter caps.

Referring in more detail to the drawings, FIGS. 1-4 show a carburetor 10 that provides a fuel and air mixture to an engine to support operation of the engine. The carburetor 10 may be a diaphragm type carburetor, as shown, or any other air-fuel charge forming device suitable for use as described herein. The carburetor may be constructed and function as generally set forth in U.S. Pat. No. 4,752,420 which is incorporated herein by reference in its entirety.

The carburetor 10 may include at least one valve adjustable to control the air and fuel mixture ratio. As shown, the carburetor includes two needle valves 12, 14 rotatably carried by a carburetor body 16 in separate needle valve passages 18 (only one of which is shown) formed in the body. The carburetor 10 may include a cavity 40 in which the needle valves 12, 14 are received or an outwardly extending projection or cover 42 (as in the implementation shown) surrounding the needle valves 12, 14 and having a cavity 40 in which the needle valves 12, 14 are located in assembly, or a combination of the two. Rotation of the needle valves 12, 14 in one direction advances the needle valves further into the carburetor body 16 and rotation in the other direction retracts the needle valve from the carburetor body. Such rotation of the needle valves 12, 14 moves a tip 22 (FIG. 5) of the needle valve relative to a port or passage 24 (FIG. 1) through which fuel flows in the carburetor body 16 to control the flow rate of fuel through that port or passage. In the implementation shown, one needle valve 12 controls fuel flow through part of a low speed fuel circuit and the other needle valve 14 controls fuel flow through part of a high speed fuel circuit. Each needle valve 12, 14 may receive a limiter cap 26, 27 to control or limit rotation of the valves and hence, adjustment of the flow rate of fuel through the respective fuel circuit in the carburetor 10.

Referring to FIGS. 1-4, the needle valves 12, 14 may be arranged generally parallel to each other, side-by-side, and may be rotated independently of each other through at least a portion of their adjustment range. Each needle valve 12, 14 may have the same features and so only one needle valve 12 will be further described.

Figure 5:
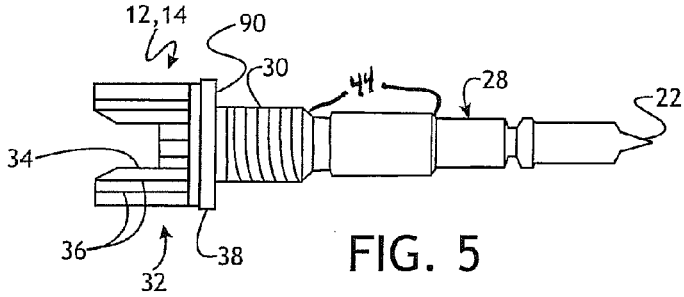
FIG. 5 is a side view of a needle valve.

As best shown in FIG. 5, the needle valve 12 may have a shank 28 with a threaded portion 30 that engages complementary threads formed in its associated needle valve passage 18. A head 32 (FIGS. 5 and 6) may extend axially from a rear end of the shank 28 and, in order to rotate and adjust the valve 12, a tool receiving feature, such as a recess or slot 34 may be defined in the head 32. The slot 34 may be generally perpendicular to the longitudinal axis of the shank 28 and may receive a tool, such as a screwdriver, for rotation of the needle valve 12. Of course, the tool receiving feature 34 may be formed in any desired shape or orientation, and may include a projection rather than a cavity or slot. An outer radial surface of head 32 may have axially extending serrations 36 to facilitate coupling the needle valve 12 with its associated limiter cap 26, 27 as will be described in more detail herein. The serrations 36 may be formed around all or only part of the head 32, and may be formed as discrete serrations or in spaced apart groups of serrations, as desired. A radially outwardly extending flange 38 may define a maximum diameter portion of the head 32, and may have a diameter greater than the outer diameter of the serrated portion of the head. The flange 38 may be disposed axially between the serrations 36 and the tip 22, and may, if desired, be circumferentially continuous. Both the flange 38 and the serrations 36 may be accessible from outside of the carburetor body 16 to facilitate assembly of the limiter caps 26, 27 onto the valves 12, 14, and to facilitate adjustment of the valves. The needle valve 12 may include one or more shoulders 44 or other features adapted to provide or engage a seal within the carburetor body 16 to inhibit or prevent fuel leaking from the carburetor 10.

Figure 14:
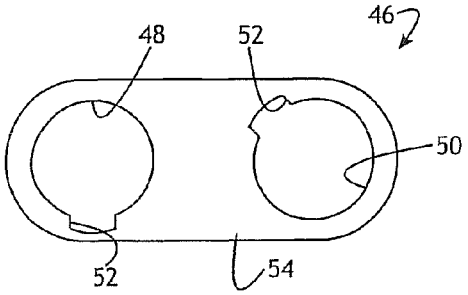
FIG. 14 is a top view of a plug.
Figure 15:
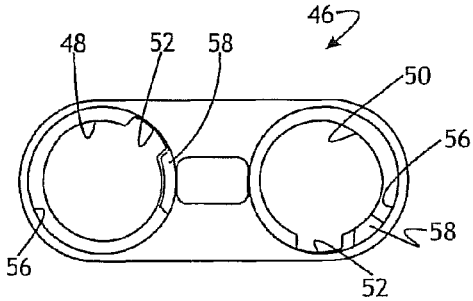
FIG. 15 is a bottom view of the plug.

In the implementation wherein the carburetor body 16 includes an outwardly extending cover 42 and/or a cavity 40 surrounding the needle valves 12, 14, a plug 46 may be provided in an open end of the cavity 40 to limit access to the needle valves 12, 14. The plug 46 may be formed of metal, and may be press-fit, adhered, welded or connected by any other suitable means to the carburetor body 16, such as by crimping or deforming a portion of the end of the cover 42 or carburetor body material over the plate. As shown in at least FIGS. 14 and 15, the plug 46 may include an opening for each needle valve 12, 14, and is shown here as having two such openings 48, 50. Separate slots 52 may be provided in the plug 46 extending into each opening 48, 50. The slots 52 may be oriented circumferentially about their associated openings 48, 50 in any desired position. The plug 46 may have a generally flat outer surface 54 visible from the exterior of the carburetor body 16 and one or more counterbores 56 coaxial with the openings and open to a surface of the plate opposite the outer surface. That is, beneath the outer surface 54 of the plug, the openings 48, 50 may become wider or have a larger diameter over at least a portion of their circumference. One or more radially inwardly extending stop surfaces 58 may be provided in the counterbores 56. Such stop surfaces 58 may extend inwardly from the surface defining the counterbore 56, but may still be spaced radially outwardly from an edge 58 of the adjacent opening 48, 50 in the outer surface 54.

The limiter caps 26, 27 for the needle valves may be identical, or different, as desired in a given application. In the implementation shown, the limiter caps 26, 27 are identical so only one cap 26 will be described further.

As shown in at least FIGS. 7-11, the limiter cap 26 may have a generally cylindrical sidewall 60 having a diameter slightly smaller than the diameter of an associated opening 48 in the plug 46 so that the limiter cap 26 may be received through the opening 48 with limited clearance between them. The sidewall 60 extends between an open first end 62 and a second end 64 having an end wall 66 with an actuating feature adapted to receive a tool or other actuator. In this regard, the actuation feature may include a cavity, recess or slot 68 (FIGS. 9 and 10) adapted to receive a tool and permit rotation of the limiter cap 26 and associated needle valve 12. A through bore 70 may be provided through the end wall 66 to provide access to the needle valve head 32 when the limiter cap 26 is assembled onto the needle valve 12, or to permit a tool to act on an inner surface 72 of the end wall 66 so that the limiter cap 26 may be pulled off a needle valve 12. Preferably, a significant force is required to remove the limiter cap 26 from the needle valve 12 when they are fully assembled together so that an end user cannot easily do so. The limiter cap 26 may be formed of metal, and may be formed in one-piece so that each feature is integral to and formed in one-piece with the limiter cap 26.

Figure 9:
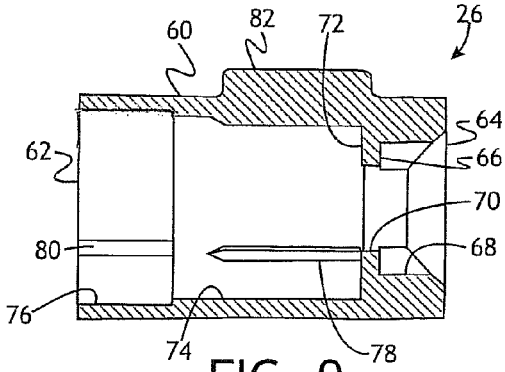
FIG. 9 is a cross-sectional view of the limiter cap.
Figure 10:
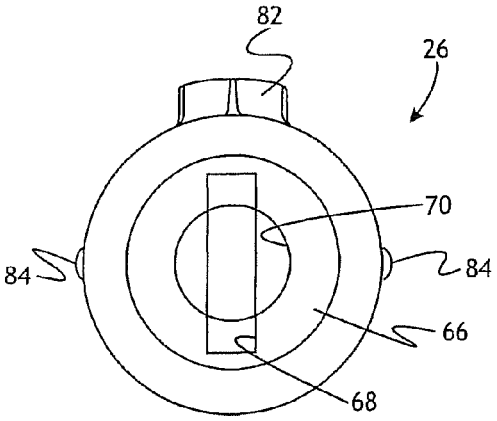
FIG. 10 is a top view of the limiter cap.
Figure 11:
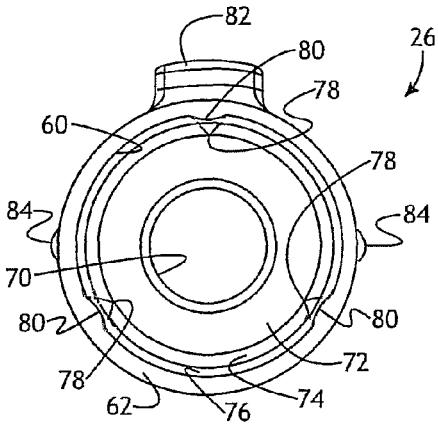
FIG. 11 is a bottom view of the limiter cap.

As best shown in FIG. 9, a first counterbore or cavity 74 may be formed between the limiter cap ends and open at one end to the through bore 70 and at its other end to a second counterbore or cavity 76. One or more radially inwardly extending driving features 78, which may be formed as thin fingers or ridges, may be provided within the first cavity 74. The driving features 78 are designed to mate with or otherwise engage the valve head serrations 36 to couple the limiter cap 26 and needle valve 12 together for co-rotation when fully assembled together. Any number of driving features 78 may be provided, and in the implementation shown there are three driving features 78 and they may, but need not be, equally spaced apart around the circumference of the first cavity 74. The second cavity 76 may have a diameter greater than the first cavity 74 and may be open to the lower end of the limiter cap 26. One or more inwardly extending features, such as thin ribs 80, may also be provided in the second cavity 76. The ribs 80 may likewise mate with or engage the serrations 36 and may be formed in any number and spacing. These features may axially align the needle valve head 32 with the smaller diameter first cavity 74 during an initial staging phase when the limiter cap 26 is installed on a needle valve 12. In one form, the ribs 80 do not extend radially inwardly as far as the driving features 78 (such as shown in FIG. 11), but are circumferentially aligned with the driving features to facilitate a transition of the serrations 36 from the ribs 80 to the driving features 78. To provide a rotational stop or limiter, a tab 82 may be provided extending radially outwardly from the sidewall 60. The tab 82 may have a circumferential width and radially thickness to fit through an associated slot 52 in the plug 46, and any suitable axial length. One or more rows of axially aligned nubs 84 may also be provided extending outwardly from the sidewall 60. In the implementations shown, two rows of nubs 84 are provided spaced apart about one hundred eighty degrees from each other and about ninety degrees from the tab. The nubs 84 may define intermediate and final assembly positions of the limiter caps 26, 27 by, for example, engagement with the plug.

In assembly, each needle valve 12, 14 is inserted into a passage 18, 20 in the carburetor body 16 and rotated into a desired axial position relative to a fuel port or passage 24 to provide the desired fuel flow rate through that port or passage. This may be called the calibrated position of the needle valves 12, 14 as that position relates to the desired, calibrated fuel flow rate in the carburetor 10 under the initial assembly conditions (temperature, altitude, type of fuel used during calibration, etc). It is from this calibrated position that adjustment of the needle valves 12, 14 is limited by installation of the limiter caps 26, 27 onto the needle valves 12, 14.

Figure 1:
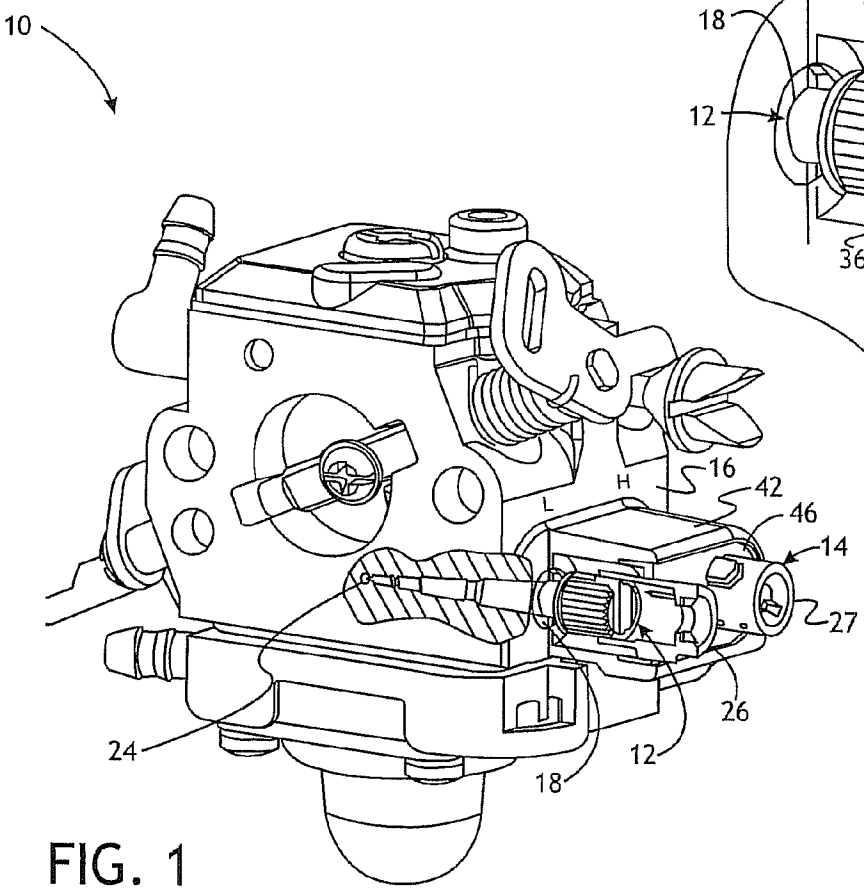
FIG. 1 is a perspective view of a carburetor having a pair of needle valves and showing limiter caps in an initial assembly position, and with a portion broken away and in section to show a needle valve passage and a fuel passage of the carburetor.

In this regard, FIGS. 1 and 2 show the limiter caps 26, 27 in an initial staging position prior to final assembly. In the initial staging position, the needle valve heads 32 are received in the second cavity 76 of the limiter caps 26, 27 where the inwardly extending ribs 80 are engaged or meshed with the serrations 36 thereby holding the heads 32 aligned with the first cavity 74. The tab 82 of each limiter cap 26, 27 is axially aligned with a slot 52 in the plug 46, and the limiter caps 26, 27 extend outwardly from the plug 46. From this position, the limiter caps 26, 27 may be further axially advanced onto the needle valves 12, 14.

Figure 4:
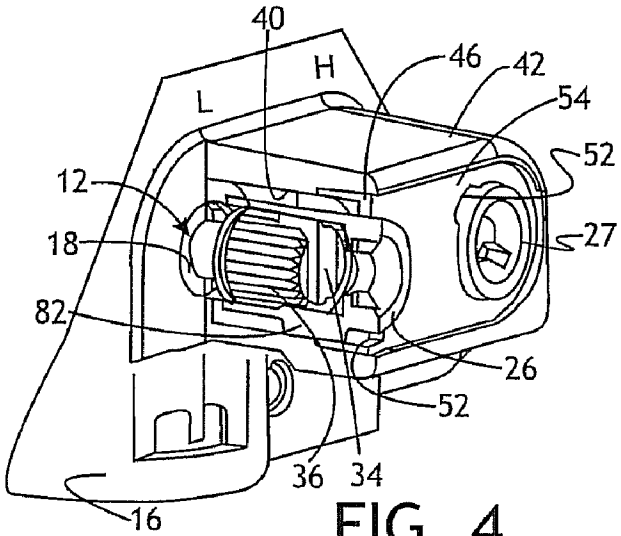
FIG. 4 is an enlarged, fragmentary view of a portion of FIG. 3 showing the ends of the needle valves and the limiter caps.
Figure 3:
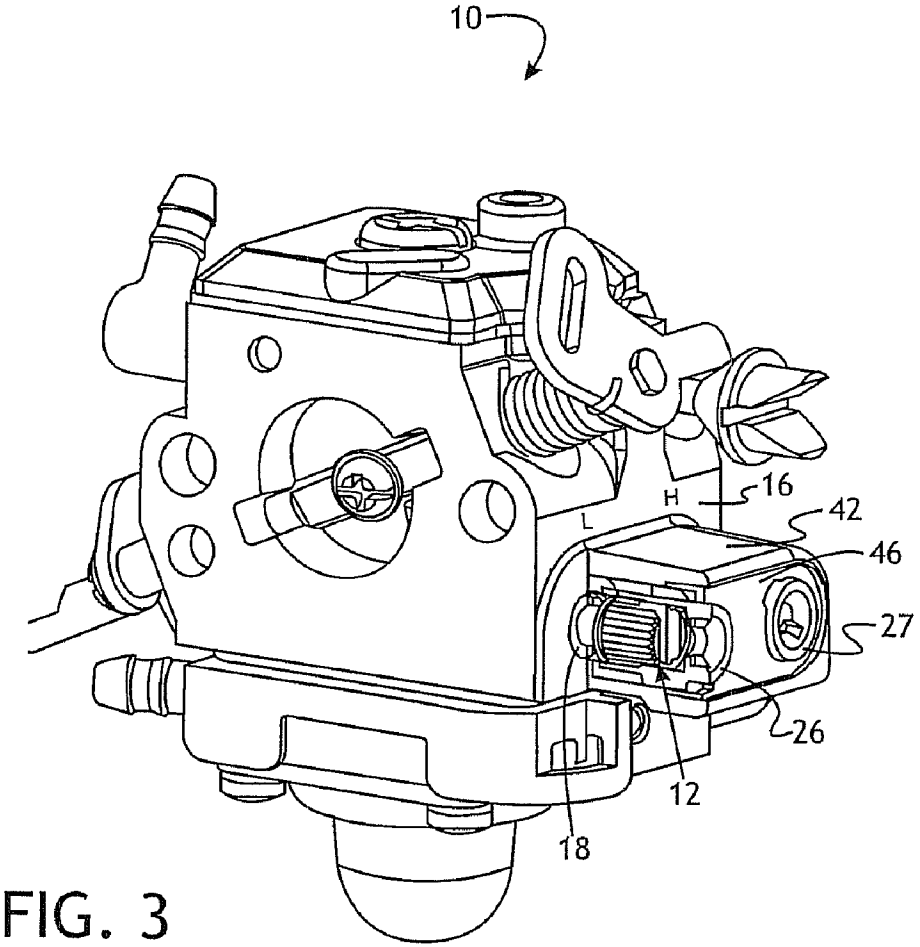
FIG. 3 is a perspective view of the carburetor with the limiter caps fully assembled onto the needle valves.

As shown in FIGS. 3 and 4, when fully assembled onto the needle valves 12, 14, the limiter caps 26, 27 may be generally flush with the outer surface 54 of the plug 46. The needle valve heads 32 may be fully received within the first cavity 74 and the flange 38 may be tightly press-fit within the first cavity 74. In this regard, the second cavity 76 may have a diameter slightly larger than the outer diameter of the flange 38 and the first cavity 74 may have a diameter equal to or slightly smaller than the diameter of the flange 38. This ensures a tight interference or friction fit between the needle valve heads 32 and the limiter caps 26, 27, possibly with deformation of one or both components as they are pressed together, so that a desired, relatively high force is required to pull the limiter caps 26, 27 off the needle valves 12, 14. This high pull-off force and the limited access to the limiter caps 26, 27 which are flush or recessed within the cover 42 and plug 46, prevent or greatly inhibit an end user from removing the limiter caps.

Figure 6:
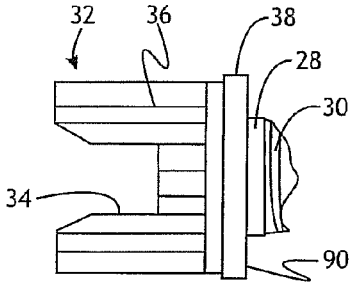
FIG. 6 is an enlarged, fragmentary view of an end of the needle valve.
Figure 7:
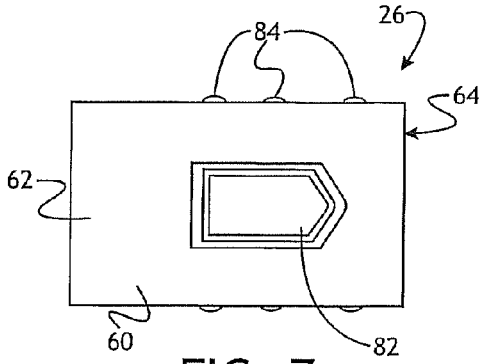
FIG. 7 is a side view of a limiter cap showing an outwardly projecting tab.
Figure 8:
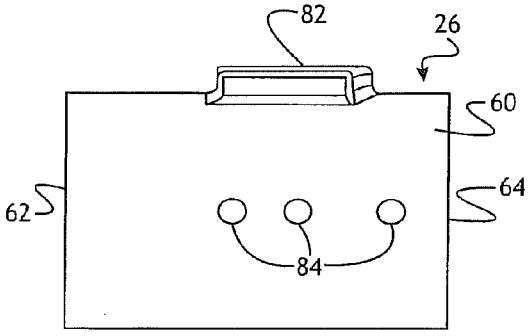
FIG. 8 is another side view of the limiter cap.
Figure 12:
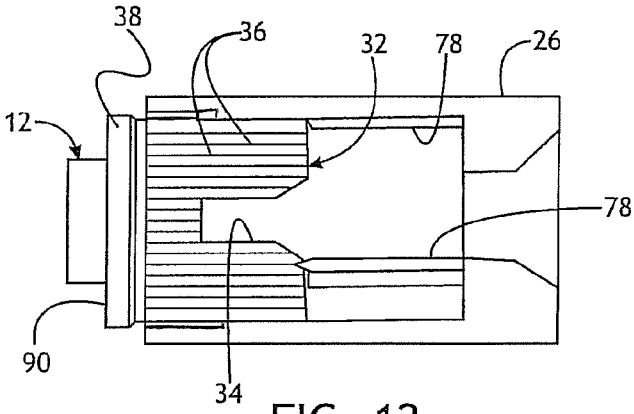
FIG. 12 is an enlarged, fragmentary, cross-sectional view of an end of a needle valve with a limiter cap in an initial assembly position.
Figure 13:
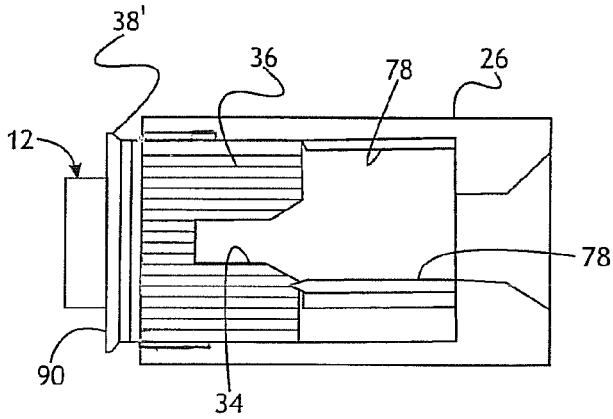
FIG. 13 is an enlarged, fragmentary, cross-sectional view of an end of another form of a needle valve with a limiter cap in an initial assembly position.

In one form, as shown in FIGS. 5, 6 and 12, the flange 38 is generally cylindrical and may be a right cylindrical portion of the head 32 which has its maximum diameter over its entire axial length. In another form, as shown in FIG. 13, the flange 38' is tapered and has its maximum diameter at only an edge of the flange. The tapered flange 38' may be tapered from a minimum diameter to a maximum diameter in the direction of installation of the limiter cap 26, 27 thereon. In other words, the open end of the limiter caps 26, 27 may pass over the smaller diameter portion of the flange 38' first to permit a lower installation force of the limiter caps onto the needle valves 12, 14, while the constant diameter flange 38 may require a greater installation force due to the greater surface area over which the interference fit is provided. The first form of the flange 38 may provide a greater interference fit and require a higher pull-off force than the second form with the tapered flange 38'. The axial length of the maximum diameter portion of the flange 38, 38' may be between about 0.1 mm and 3 mm. This relatively thin flange (thin compared to a needle valve where the entire head is the same diameter) permits the limiter caps 26, 27 to be pressed onto the needle valves 12, 14 with a force of between about 50 N and 150 N, and requires a similar force of between about 50 N to 150 N to pull the limiter caps 26, 27 off the needle valve heads 32. The interference or friction fit may also be provided between the driving features 78 and the serrations 36 that they are intermeshed with and one or both may be deformed slightly in assembly, if desired. In any form, the driving features 78 are meshed or mated with the serrations 36 so that each limiter cap 26, 27 co-rotates with its associated needle valve 12, 14. The pull-off force is further improved by forming the limiter caps 26, 27 and needle valves 12, 14 out of metal. And may be improved further still by forming a relatively sharp lower edge 90 on the flange 38, 38' so that any tilting of the limiter caps 26, 27 relative to the longitudinal axis of the needle valves 12, 14 during removal will tend to cause the edge 90 to dig into and further engage the limiter cap 26, 27. In at least certain implementations, the edge 90 may have no radius, which is to say that the edge is made as sharp as possible during formation of the needle valves 12, 14. Compared to a plastic limiter cap, a metal limiter cap may also be harder to deform and hence, will maintain a tighter friction fit with the metal needle valve head 32. Further, it may also be possible for plastic limiter cap to melt or otherwise deform under heat or other forces (e.g. cutting or mashing) where a metal limiter cap would not.

Figure 16:
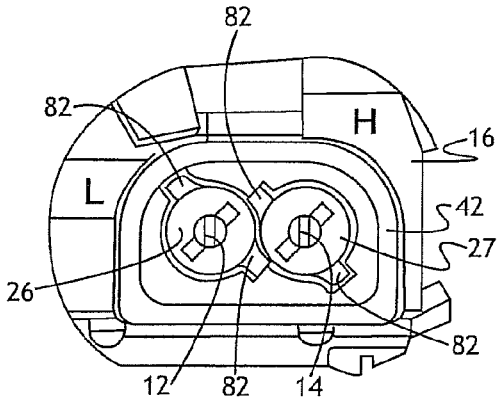
FIG. 16 is a fragmentary side view of a portion of a carburetor including two adjacent needle valves and another embodiment of limiter caps assembled onto the needle valves.

Accordingly, to adjust the needle valve position when the limiter caps 26, 27 are fully assembled onto the needle valves, a tool may be inserted into the actuation feature 68 of the limiter cap 26, 27 to rotate the limiter cap and the needle valve 12, 14 to which that limiter cap is connected. Maximum rotation of the needle valve 12, 14 in each direction is limited by engagement of the tab 82 with the stop surface(s) 58 in the plug 46. Of course, the tabs 82 could also engage other features to limit rotation, like a stop provided on the carburetor body (e.g. the cover). Also, as shown in FIG. 16, the needle valves 12, 14 could be positioned relatively close together so that one or more tabs 82 on one limiter cap 26 engage one or more tabs 82 on the adjacent limiter cap 27 to limit the rotation of one or both of the limiter caps 26, 27 and associated needle valves 12, 14. In other words, rather than engaging a plug or the carburetor body, the adjacent limiter caps may engage each other to limit their rotation, and hence, the rotation of their associated needle valves.

It is to be understood that the foregoing description is not a definition of the invention but is a description of one or more preferred exemplary embodiments of the invention. The invention is not limited to the particular embodiment(s) disclosed herein but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example", "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

We claim:

1. A carburetor valve and limiter cap assembly for limiting adjustment of fuel flow in a carburetor, comprising:

a needle valve having a tip, a threaded portion, and a head having a flange with an outer diameter greater than the rest of the head and one or more serrations formed on the head; and a limiter cap having a sidewall, a tab extending outwardly from the sidewall, a first cavity having an inner diameter sized for an interference fit with the flange, and at least one driving feature to engage at least one serration so that rotation of the limiter cap causes rotation of the needle valve, wherein the interference fit between the flange and the limiter cap inhibits removal of the limiter cap from the needle valve.

2. The assembly according to claim 1 wherein the flange is circumferentially continuous and the serrations are spaced from and not formed in the flange.

3. The assembly according to claim 1 wherein the needle valve and the limiter cap are both formed of metal.

4. The assembly according to claim 1 wherein the limiter cap also includes a second cavity that is open to the first cavity and in which the head is initially received when the limiter cap is installed onto the needle valve, the second cavity having a larger inner diameter than the first cavity and plurality of spaced apart and inwardly extending ribs adapted to engage the head and align the head with the first cavity.

5. The assembly according to claim 1 wherein the maximum diameter portion of the flange has an axial length of between 0.1 mm and 3 mm.

6. The assembly according to claim 5 wherein the flange is tapered in a direction of assembly of the limiter cap onto the head.

7. The assembly according to claim 5 wherein the flange is a right cylindrical portion of the head.

8. The assembly according to claim 1 wherein three driving features are provided in the first cavity to reduce the force required to install the limiter cap onto the needle valve, and the driving features are uniformly spaced apart.

9. The assembly according to claim 4 wherein each rib is circumferentially aligned with a driving feature.

10. A carburetor, comprising:

a body having a fuel passage formed therein, and a needle valve passage communicating with the fuel passage and having a threaded portion;

a needle valve received in the needle valve passage and having a tip movable relative to a portion of the fuel passage to control the flow rate of fuel in the fuel passage, the needle valve also having a threaded portion engaged with the threaded portion of the needle valve passage, and a head having a flange with an outer diameter greater than the rest of the head and one or more serrations formed on the head, and a limiter cap having a sidewall, a tab extending outwardly from the sidewall, a first cavity having an inner diameter sized for an interference fit with the flange, and at least one driving feature to engage at least one serration so that rotation of the limiter cap causes rotation of the needle valve, wherein the interference fit between the flange and the limiter cap inhibits removal of the limiter cap from the needle valve.

11. The carburetor according to claim 10 wherein the body includes a cover extending outwardly from the rest of the carburetor body and covering the needle valve.

12. The carburetor according to claim 11 wherein the cover also covers the limiter cap when installed on the needle valve to limit end user access to the limiter cap.

13. The carburetor according to claim 12 which also includes a plug received in the cover and further limiting access to the limiter cap.

14. The carburetor according to claim 13 wherein the plug includes a stop surface located so as to be engaged by the tab during a portion of the limiter cap rotation to limit rotation of the limiter cap.

15. The carburetor according to claim 10 wherein the flange is circumferentially continuous and the serrations are spaced from and not formed in the flange.

16. The carburetor according to claim 10 wherein the needle valve and the limiter cap are both formed of metal.

17. The carburetor according to claim 10 wherein the limiter cap also includes a second cavity that is open to the first cavity and in which the head is initially received when the limiter cap is installed onto the needle valve, the second cavity having a larger inner diameter than the first cavity and a plurality of spaced apart and inwardly extending ribs adapted to engage the head and align the head with the first cavity.

18. The carburetor according to claim 10 wherein the maximum diameter portion of the flange has an axial length of between 0.1 mm and 3 mm.

19. The carburetor according to claim 18 wherein the flange is tapered in a direction of assembly of the limiter cap onto the head.

20. The carburetor according to claim 18 wherein the flange is a right cylindrical portion of the head.

21. The carburetor according to claim 10 wherein three driving features are provided in the first cavity to reduce the force required to install the limiter cap onto the needle valve, and the driving features are uniformly spaced apart.

22. The carburetor according to claim 17 wherein each rib is circumferentially aligned with a driving feature.

23. The carburetor according to claim 10 wherein a pair of needle valve passages are provided adjacent to each other, two needle valves are provided with one needle valve in each needle valve passage, and two limiter caps are provided with one limiter cap on each needle valve, and wherein the tab on the limiter cap of at least one needle valve is arranged to engage a portion of the limiter cap of the other needle valve to limit the rotation of the needle valves.

24. The carburetor according to claim 10 wherein a pair of needle valve passages are provided adjacent to each other, two needle valves are provided with one needle valve in each needle valve passage, and two limiter caps are provided with one limiter cap on each needle valve, and wherein the tabs on the limiter caps are arranged to engage a portion of the carburetor body to limit rotation of the limiter caps.

25. The carburetor according to claim 24 wherein the carburetor body includes a plug disposed in a cavity in the carburetor body, and the plug includes one or more stop surfaces arranged to be engaged by the tabs.

* * * * *

UNITED STATES PATENT AND TRADEMARK OFFICE

CERTIFICATE OF CORRECTION

PATENT NO. : 8,348,244 B2
APPLICATION NO. : 12/843008
DATED : January 8, 2013
INVENTOR(S) : Tetsuji Kojima et al.

It is certified that error appears in the above-identified patent and that said Letters Patent is hereby corrected as shown below:

In the Claims:

Column 7, Line 22, after "and" insert --a--.

Signed and Sealed this
Fourth Day of June, 2013

Teresa Stanek Rea
*Acting Director of the United States Patent and Trademark Office*